US008334881B2

(12) United States Patent
Lin et al.

(10) Patent No.: US 8,334,881 B2
(45) Date of Patent: Dec. 18, 2012

(54) IMAGE-DRIVING METHOD AND DRIVING CIRCUIT OF DISPLAY AND DISPLAY APPARATUS

(75) Inventors: I-Feng Lin, Hsinchu (TW); Yu-Tsung Hu, Changhua County (TW)

(73) Assignee: Novatek Microelectronics Corp., Hsinchu (TW)

( * ) Notice: Subject to any disclaimer, the term of this patent is extended or adjusted under 35 U.S.C. 154(b) by 1239 days.

(21) Appl. No.: 12/127,831

(22) Filed: May 28, 2008

(65) Prior Publication Data

US 2009/0167790 A1 Jul. 2, 2009

(30) Foreign Application Priority Data

Dec. 28, 2007 (TW) ..... 96151040 A

(51) Int. Cl.
*G09G 5/10* (2006.01)

(52) U.S. Cl. ..... 345/690; 345/426; 345/428; 345/589; 345/545; 345/547; 345/647; 348/448; 348/458; 348/490; 348/503; 348/620

(58) Field of Classification Search ..... None
See application file for complete search history.

(56) References Cited

U.S. PATENT DOCUMENTS

| | | | | |
|---|---|---|---|---|
| 7,817,113 | B2 * | 10/2010 | Hashimoto et al. | 345/63 |
| 2007/0176881 | A1 * | 8/2007 | Lin | 345/100 |
| 2010/0156926 | A1 * | 6/2010 | Furukawa et al. | 345/589 |

FOREIGN PATENT DOCUMENTS

| | | |
|---|---|---|
| TW | I251199 | 3/2006 |
| TW | 200617868 | 6/2006 |
| TW | 200717405 | 5/2007 |
| TW | 200721089 | 6/2007 |

OTHER PUBLICATIONS

"Office Action of Taiwan counterpart application" issued on Apr. 16, 2012, p. 1-p. 4.

* cited by examiner

*Primary Examiner* — Antonio A Caschera
(74) *Attorney, Agent, or Firm* — Jianq Chyun IP Office

(57) ABSTRACT

A image-driving method for a display includes receiving an image frame and registering at least a part of the image frame, wherein the image frame is divided into a prior-part frame and a post-part frame; respectively conducting a first luminance adjustment on the prior-part frame and the post-part frame so as to take the adjustment results as a first part of a first image frame and a first part of a second image frame; filling the previous received image frame after a second luminance processing into a second part of the first image frame; filling the presently received image frame after a second luminance processing into a second part of the second image frame; outputting the complete first image frame and the complete second image frame for successive displaying.

26 Claims, 10 Drawing Sheets

IMAGE-DRIVING METHOD AND DRIVING CIRCUIT OF DISPLAY AND DISPLAY APPARATUS

CROSS-REFERENCE TO RELATED APPLICATION

This application claims the priority benefit of Taiwan application serial no. 96151040, filed Dec. 28, 2007. The entirety of the above-mentioned patent application is hereby incorporated by reference herein and made a part of this specification.

BACKGROUND OF THE INVENTION

1. Field of the Invention

The present invention generally relates to an image display technique, and more particularly, to an image-driving method and a driving circuit of a display.

2. Description of Related Art

In recent years, how to improve the blur motion image of a liquid crystal display (LCD) has become one of concerned issues of the relevant manufacturers. The problem of blur motion image is caused by slow response speed of liquid crystal molecules and the employed hold-type driving scheme in a display. To effectively overcome the problem of slow response speed, an over-drive technique was provided in the prior art. The conventional hold-type driving scheme has been continuously developed in two directions of impulsive drive scheme and motion estimation and compensation scheme. However, no matter of the over-drive technique, impulsive drive scheme or motion estimation and compensation scheme, a large memory capacity is required for tremendous accesses. In addition, if an architecture combines two of the above-mentioned schemes, the display needs a large bandwidth and a huge capacity of the employed memory.

FIG. 1 is a diagram showing an impulsive drive mechanism. Referring to FIG. 1, the adopted impulsive drive mechanism needs to insert a darker image between two original images, wherein the darker image is obtained by conducting a Gamma correction with a darker Gamma curve 100 instead of the regular and desired Gamma curve 104 on the original image. In addition, another brighter image is also required, wherein the brighter image is obtained by conducting a Gamma correction with a brighter Gamma curve 102 on the original image. As a result, the average luminance of the above-mentioned two images is close to the desired luminance, but the insertion of a dark frame gains the effect of impulsive drive and improves the blur motion image. The scheme is also termed as double-Gamma algorithm.

FIG. 2 is a diagram of a conventional image driving circuit to implement the impulsive drive mechanism. Referring to FIG. 2, image frame data are input into a frame doubler 106 in a rate of 60 Hz, and the input data are registered in the memory of a frame buffer 108. Then, the frame doubler 106 reads out the image data from the frame buffer 108 in a double rate of the above-mentioned input rate, i.e., 120 Hz. In other words, a present image is written into the frame buffer 108 in 16 ms duration or 60 Hz rate. Prior to writing the present image, the previous image is read twice out in 120 Hz rate. One of the read out images is sent to a dark-processing unit 110 for conducting a luminance adjustment based on a dark Gamma curve and then being output, while another of the read out images is sent to a bright-processing unit 112 for conducting a luminance adjustment based on a bright Gamma curve and being output to display. In this way, the frame frequency is updated from 60 Hz to 120 Hz, in which the two images are read out for conducting the dark and bright Gamma corrections, thus, the above-mentioned procedure is called the double-Gamma algorithm.

FIG. 3 is a diagram of a conventional image-driving method. Referring to FIG. 3, a frame 114 and another frame 120, i.e., two original frames 0 and 1, are sequentially input in 16 ms duration and stored in a frame buffer. Since an image is composed of, for example, 900 scan lines; thus, each of the sequentially input in 60 Hz rate present images is respectively represented by original frames 0, 1 . . . and each original frame includes data corresponding to the 900 scan lines. The frames 116, 118, 122 and 124 are images read out in 120 Hz rate and processed by luminance adjustments. Taking the original frame 114 as an example, the corresponding original frame 0 is read out twice from the frame buffer to get two image frames 116 and 118, wherein the frames are read out from the frame buffer one by one and then Gamma corrections with a bright Gamma curve and a dark Gamma curve are alternately and respectively conducted on the read out frames to obtain a bright frame 0 and a dark frame 0 for displaying. It can be seen from the above mentioned that the next image, i.e. the original frame 1, can be read only after completely reading out the previous original frame 0. Therefore, the circuit architecture must allow a whole image to be registered in the frame buffer until the registered image is read out twice to inputting the following original image, therefore, the conventional image-driving method has a lower operation efficiency.

In short, how to effectively solve the problem with a conventional display, for example an LCD, requiring excessive access bandwidth and memory capacity is still a significant development task for the relevant manufactures.

SUMMARY OF THE INVENTION

Accordingly, the present invention is directed to an image-driving scheme and the implementation thereof for a display, which is able to at least solve the problem of excessive access bandwidth and memory capacity.

The present invention provides an image-driving method for a display. The image-driving method includes: registering a post-part image frame of a previous image frame; receiving an image frame, wherein the image frame is divided into a prior-part image frame and a post-part image frame; producing a first display frame and a second display frame both corresponding to the received image frame, and respectively dividing the first display frame and the second display frame into a prior-part frame and a post-part frame; simultaneously displaying the above-mentioned prior-part frames and post-part frames according to a rule. The rule herein includes: displaying an image data obtained by adjusting the prior-part image frame of the above-mentioned received image frame according to a first luminance condition at the position of the prior-part frame of the first display frame; displaying an image data obtained by adjusting the post-part image frame of the previous image frame according to a second luminance condition at the position of the post-part frame of the first display frame; displaying an image data obtained by adjusting the prior-part image frame of the above-mentioned received image frame according to a second luminance condition at the position of the prior-part frame of the second display frame; displaying an image data obtained by adjusting the post-part image frame of the above-mentioned received image frame according to a first luminance condition at the position of the post-part frame of the second display frame.

In the image-driving method for a display provided by an embodiment of the present invention, for example, the above-mentioned image frame is received in a frequency, and the above-mentioned first display frame and second display frame are produced for sequentially displaying in a multiple of the above-mentioned frequency.

In the image-driving method for a display provided by an embodiment of the present invention, for example, the first luminance condition is different from the desired luminance condition.

In the image-driving method for a display provided by an embodiment of the present invention, for example, the post-part image frame of the initial first display frame does not display the image thereof.

In the image-driving method for a display provided by an embodiment of the present invention, for example, when the above-mentioned received image frame is different from the previous image frame and if it is needed, the method further includes conducting an overdrive process on the data of the above-mentioned image frame.

The present invention further provides an image-driving method for a display. The method includes: receiving an image frame and registering at least a part of the image frame, wherein the image frame is divided into a prior-part frame and a post-part frame; respectively conducting a first luminance adjustment on the prior-part frame and the post-part frame so as to take the conducted results as a first part of a first image frame and a first part of a second image frame; inserting the data of the prior received image frame after conducting a second luminance processing on the previous received image frame into a second part of the first image frame; inserting the data of the presently received image frame after conducting a second luminance processing on the presently received image frame into a second part of the second image frame; outputting the complete first image frame and second image frame for the following displaying.

The present invention provides an image-driving circuit for a display, which includes a frame buffer, a frame doubler, a first frame line buffer, a first luminance adjustment unit, a second frame line buffer and a second luminance adjustment unit. The frame doubler is coupled to the frame buffer, receives an image frame in a first frequency and writes the above-mentioned image frame into the frame buffer according to a scan line sequence. The first frame line buffer sequentially and directly receives the scan lines of the image frame, wherein the image frame is divided into a prior-part image frame serving as a part of the image data of a first output frame, and a post-part image frame serving as a part of the image data of a second output frame. The first luminance adjustment unit is coupled to the first frame line buffer so as to adjust the input image frame with a first luminance condition. The second frame line buffer reads out the part of the image frame stored in the frame buffer through the frame doubler. The prior-part image frame corresponding to the first output frame reads out the post-part image frame of the previous received image frame, or the post-part image frame corresponding to the second output frame reads out the prior-part image frame of the above-mentioned image frame. The second luminance adjustment unit is coupled to the second frame line buffer and adjusts the input image frame with a second luminance condition. The prior-part image frame and the post-part image frame, on which luminance adjustments are conducted respectively, compose the above-mentioned first frame and second frame for outputting in a second frequency.

In the image-driving circuit for a display provided by an embodiment of the present invention, for example, the second frequency for outputting is a multiple of the first frequency for inputting.

In the image-driving circuit for a display provided by an embodiment of the present invention, for example, the first luminance condition is different from a desired luminance condition.

In the image-driving circuit for a display provided by an embodiment of the present invention, for example, the post-part image frame of the initial first display frame does not display the image thereof.

In the image-driving circuit for a display provided by an embodiment of the present invention, for example, the capacity of the frame buffer is sufficient to store the data of a frame.

In the image-driving circuit for a display provided by an embodiment of the present invention, for example, the capacity of the frame buffer is required merely to store the data of a half frame.

In the image-driving circuit for a display provided by an embodiment of the present invention, for example, the second frame line buffer starts to read data prior to inputting the present image frame.

In the image-driving circuit for a display provided by an embodiment of the present invention, for example, the second frame line buffer starts to read data after inputting the present image frame.

The present invention further provides an image-driving circuit for a display, which includes a frame buffer, a frame doubler, a first frame line buffer, a second frame line buffer, a third frame line buffer, an overdriver, a first luminance adjustment unit and a second luminance adjustment unit. The frame doubler is coupled to the frame buffer, receives an image frame in a first frequency and writes the above-mentioned image frame into the frame buffer according to a scan line sequence. The first frame line buffer sequentially and directly receives the scan lines of the image frame, wherein the image frame is divided into a prior-part image frame serving as a part of the image data of a first output frame, and a post-part image frame serving as a part of the image data of a second output frame. The second frame line buffer reads out a part of the image frame stored in the frame buffer through the frame doubler, wherein the prior-part image frame corresponding to the first output frame reads out the post-part image frame of the previous received image frame, or the post-part image frame corresponding to the second output frame reads out the prior-part image frame of the above-mentioned image frame. The third frame line buffer reads out a part of the data of the previous received image frame stored in the frame buffer through the frame doubler, wherein the part of the data of the image frame is corresponding to the part of the image data read by the first frame line buffer. The overdriver receives the part of the image data output from the first frame line buffer and the part of the image data output from the third frame line buffer and adjusts the luminance of the part of the image data output from the first frame line buffer. The first luminance adjustment unit is coupled to the second frame line buffer and adjusts the input image frame with a second luminance condition. The second luminance adjustment unit is coupled to the overdriver and adjusts the above-mentioned image frame with a first luminance condition. The prior-part image frame and the post-part image frame on which luminance adjustments are conducted respectively compose the above-mentioned first frame and second frame for outputting in a second frequency.

In the image-driving circuit for a display provided by an embodiment of the present invention, for example, when the received image frame is different from the previous received image frame and if it is needed, an overdriving process is conducted on the image frame.

The present invention further provides an image-driving method for a display. The method includes: dividing the plurality of scan lines of a display frame into a first set of scan lines and a second set of scan lines according to the sequence of the scan lines; receiving an input image data; alternately conducting a first color luminance correction and a second color luminance correction on a first part of the input image data corresponding to the first set of scan lines so as to obtaining corrected first parts for the first set of scan lines to display; alternately conducting a second color luminance correction and a first color luminance correction on a second part of the input image data corresponding to the second set of scan lines so as to obtaining corrected second parts for the second set of scan lines to display. Note that in a frame period, the output images of the first set of scan lines and the second set of scan lines are sequentially displayed in the same frame period.

The present invention also provides a display apparatus, which includes: a display array composed of a plurality of pixels and having a plurality of rows as a plurality of scan lines, wherein the scan lines are divided into a first set of scan lines and a second set of scan lines; a driving circuit for driving the pixels corresponding to the scan lines to display an image data, wherein the first set of scan lines and the second set of scan lines are sequentially displayed in a same image display period, and two color luminance correction are alternately conducted on the first set of scan lines and the second set of scan lines.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
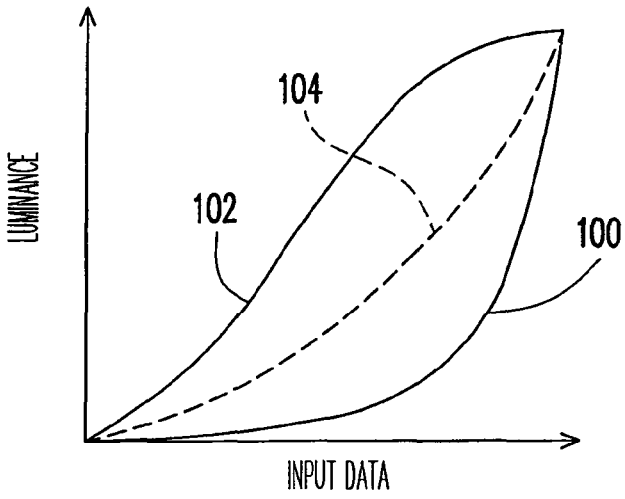
FIG. 1 is a diagram showing a impulsive drive mechanism.
Figure 2:
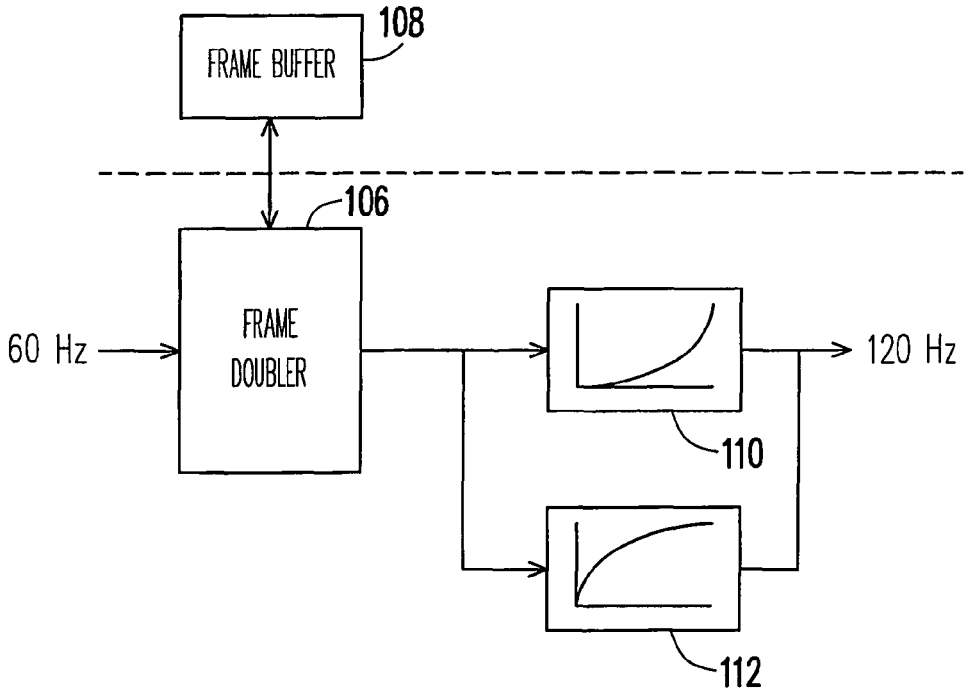
FIG. 2 is a diagram of a conventional image driving circuit to implement the impulsive drive mechanism.
Figure 3:
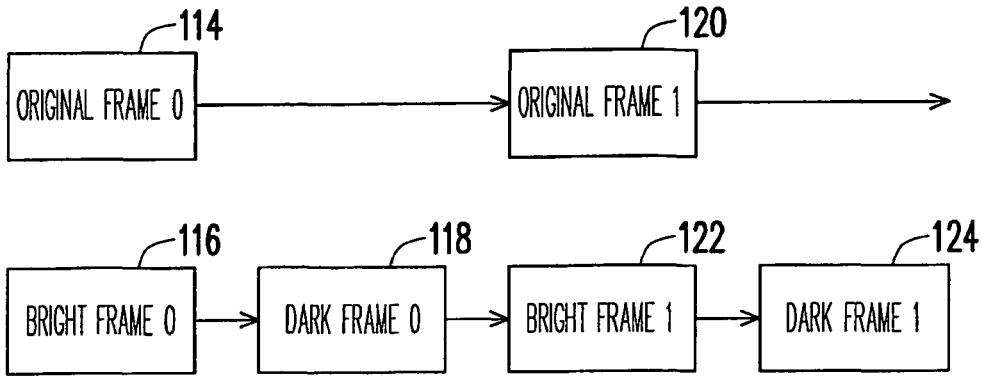
FIG. 3 is a diagram of a conventional image-driving method.

Reference will now be made in detail to the present preferred embodiments of the invention, examples of which are illustrated in the accompanying drawings. Wherever possible, the same reference numbers are used in the drawings and the description to refer to the same or like parts.

The image-driving method of a display panel provided by the present invention can be applied to, for an example, an LCD or other flat displays. The present invention employs a mechanism, that an original frame and an updated frame to be inserted are simultaneously output, so that the original frame can be immediately output without registering in a memory and only a half image of the updated frame is to be inserted and registered. Therefore, the present invention is able to reduce the requirement of bandwidth and capacity of the employed memory. The display scheme of the present invention can be further applied to any algorithm to convert a frame rate of 60 Hz into 120 Hz. In addition, the present invention also allows to combine the overdrive technique to promote the liquid crystal response speed. Since the present invention conducts an overdrive processing only on the original frame, thus, only a half of image needs to be registered. Besides, the following several embodiments can be appropriately combined to be implemented without the limitation of independent embodiments for applications.

Figure 4:
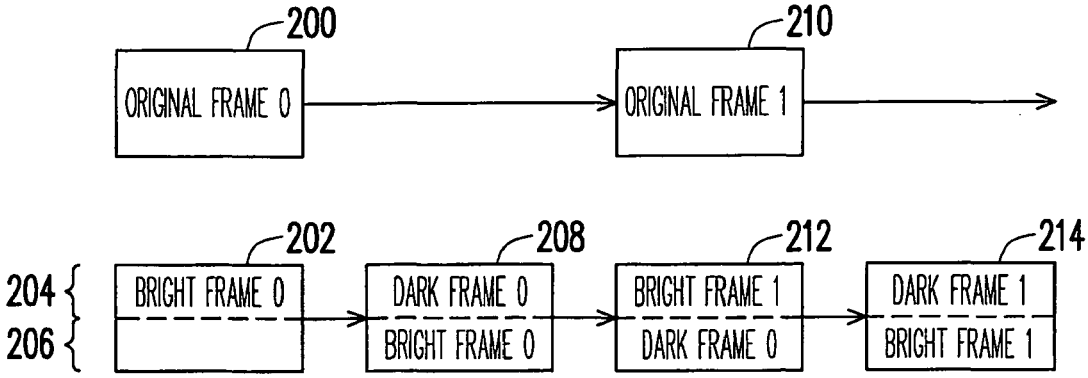
FIG. 4 is a diagram of an image-driving method according to the embodiment of the present invention.

FIG. 4 is a diagram of an image-driving method according to the embodiment of the present invention. Referring to FIG. 4, for example, two image frames 200 and 210 are the original frames 0 and 1 input in a rate, and image frames 202, 208, 212 and 214 are the image frames to be output, wherein only two frames are shown for depiction of the image-driving mechanism. The input rate, i.e. the frame rate, is, for example, 60 Hz; but the output rate is double, for example, 120 Hz.

The first input image frame 200 is corresponding to the initial status and is represented as the original frame 0. The present invention herein takes a complete image frame having, for example, 900 scan lines as an example, while the real number of the scan lines for a frame has no limitation.

The image-driving mechanism of the present invention includes, first, dividing a frame into a bright-part frame and a dark-part frame. Accordingly, the frame is divided into an upper block and a lower block, wherein the upper block is also called as the prior-part frame which contains the scan line data belonging to the upper half-part, and the lower block is also called as the post-part frame which contains the scan line data belonging to the lower half-part. When the upper half-part displays a bright frame, the lower half-part displays a dark frame, vice versa. Since the bright and dark half-parts are simultaneously and alternately displayed, thus, the frame is scanned in, for example, 60 Hz only. However, in the original frame period a prior-part frame and a post-part frame with a bright data and a dark data are simultaneously and respectively output, therefore, a single pixel undergoes two accesses, which means the pixel data is updated in 120 Hz. Considering the bright frame and the dark frame are respectively displayed within the upper half-part and the lower half-part only, thus, the two positions to read the memory for the two bright and dark frames would be spaced by a half image and the starting points to display the two half frames thereof are spaced by a half image as well, so that the bright image is output corresponding to from the first scan line until the 900-th scan line and the dark bright image is output corresponding to from the 451-th scan line until the 900-th scan line, followed by from the first scan line until the 450-th scan line. In addition, a complete frame requires two images in bright and dark images simultaneously displayed, therefore, the timing to control the LCD needs to be modified accordingly. Note that the half images position bias herein is an example. In fact, other biases, for example, one third images position bias or two third images position bias are allowed without departing from the scope of the present invention.

In more detail, an initial status is corresponding to that the original frame 0 is input and sine no previous image is input prior to the time, therefore, the corresponding frame data is filled into the prior-part frame 204 of a first image frame 202 for directly outputting and displaying, wherein the data after, for example, a bright Gamma processing to be displayed is, for example, a bright frame 0. The post-part frame 206 at the time keeps not to display data. Then, when the bright frame 0 is displayed within the post-part frame 206 of the second image frame rate 208, the data of the presently received original frame 0 keeps to be displayed, and the same data after a bright Gamma processing is provided for the next displaying. Meanwhile, the prior-part frame 204 of the second image frame rate 208 displays the dark frame 0, wherein the dark frame 0 is the presently received data of the prior-part frame of the original frame 0 and the dark frame 0 is after conducting a dark Gamma processing thereon. Both the dark frame 0 and the bright frame 0 together constitute the image of the original frame 0, but divided into a bright part and a dark part. Note that the first image frame 202 and the second image frame 208 are displayed in a double frame rate, for example, 120 Hz.

The above descriptions are the displaying mechanism for displaying the original frame 0 at the initial status. Similarly, a successively received image frame is displayed. Taking the original frame 1 as an example, the original frame 1 is an updated image; thus, the corresponding frame data is filled into the prior-part frame 204 of a first image frame 212, such as the bright frame 1 produced by conducting a bright Gamma processing on the original frame 1, is provided for the next displaying. Meanwhile, a dark frame 0 produced by conducting a dark Gamma processing on the data of the post-part frame belonging to the original frame 0 is displayed within the post-part frame 206 of the first image frame 212. In other words, the first image frame 212 contains a part of image data of the present original frame 1 and a part of image data of the previous original frame 0, and both the parts are displayed simultaneously.

Further, like the display mechanism of the second image frame 208, when the post-part frame 206 of the second image frame 214 displays a bright frame 1 produced by conducting a bright Gamma processing on the post-part data of the original frame 1, the prior-part frame 204 of the second image frame 214 displays a dark frame 1 produced by conducting a dark Gamma processing on the data of the prior-part frame belonging to the original frame 1. The following received original frames are displayed with the above-described same mechanism so as to reach the effect of doubling the display frequency.

The data of the original frames are registered in the frame buffer and the data of the newly received original frames can be directly written into the frame buffer without being affected. The capacity of the frame buffer is required to merely store a complete image. If an updated data needs to be written into the frame buffer, the data of the corresponding scan lines can be read out in advance, so that the required capacity of the frame buffer is less than a complete image frame and is, for example, a half frame capacity. Besides, the present invention allows to combine the overdrive mechanism; at the time, only, for example, the bright frames need to be conducted by the overdrive processing. The embodiment of the image-driving circuit is depicted in the following.

Figure 5:
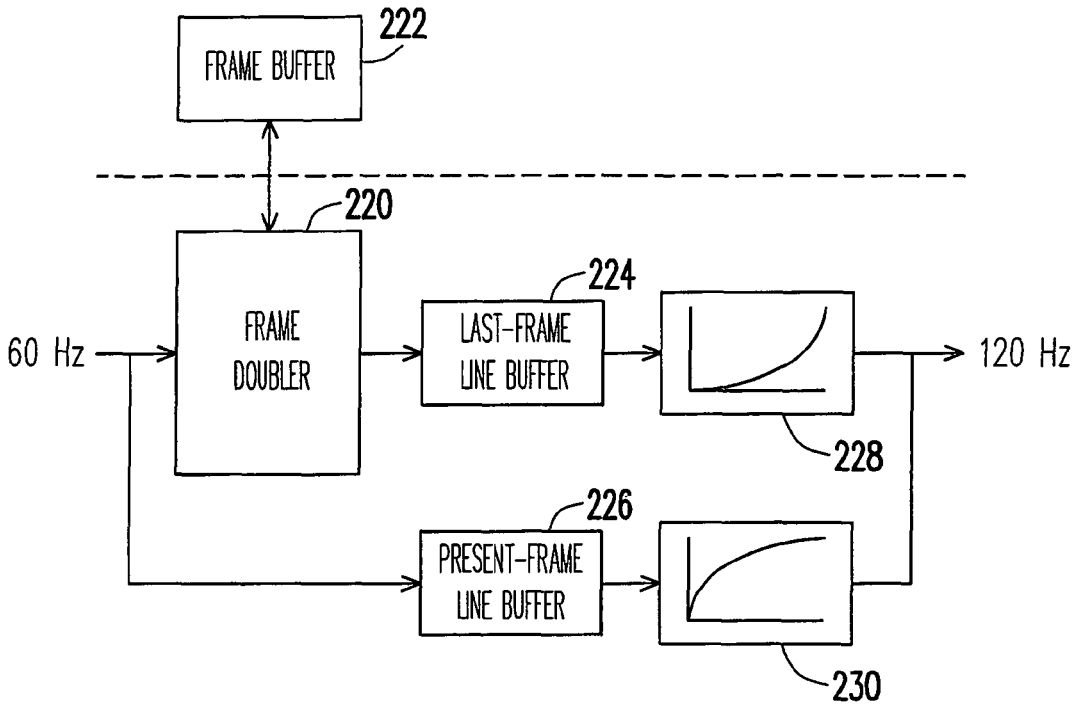
FIG. 5 is a diagram of an image-driving circuit for a display according to an embodiment of the present invention.

FIG. 5 is a diagram of an image-driving circuit for a display according to an embodiment of the present invention. Referring to FIG. 5, a frame doubler 220 is coupled to a frame buffer 222 and receives image frames in a first frequency, for example, 60 Hz. The received image frames are written into the frame buffer 222 according to the sequence of the scan lines.

In addition, a first frame line buffer, for example, the present frame line buffer 226 sequentially and directly receives a scan line or a plurality of scan lines of an image frame, which depends on the capacity of the buffer. A whole image usually is composed of a plurality of scan lines, which is operated in accordance with the operation of the frame buffer. Similarly to the mechanism of FIG. 4, an image frame is divided into a prior-part image frame and a post-part image frame, wherein the prior-part image frame is corresponding to a part of the image data of a first output frame, for example, the data from the first scan line to the 450-th scan line; the post-part image frame is corresponding to a part of the image data of a second output frame, for example, the data from the 451-th scan line to the 900-th scan line.

A first luminance adjustment unit 230 is, for example, a bright Gamma processing unit 230, which is coupled to the present frame line buffer 226 for adjusting the input image frames with a first luminance condition.

A second frame line buffer, such as the previous frame line buffer 224, reads out a part of the image frame stored in the frame buffer 222 through the frame doubler 220, wherein corresponding to the prior-part image frame of the first output frame the second frame line buffer reads out the post-part image frame of the previous received image frame, and corresponding to the post-part image frame of the second output frame the second frame line buffer reads out the prior-part image frame of the above-mentioned image frame.

A second luminance adjustment unit is, for example, the dark luminance adjustment unit 228, which is coupled to the frame line buffer 224 and adjusts the input image frame with a second luminance condition. The prior-part image frame and the post-part image frame after luminance adjustments herein respectively constitute a first frame and a second frame and are output in a second frequency. For example, the original frame is input in a frame rate of 60 Hz, and the produced first frame and the second frame are output in a frame rate of 120 Hz for the successive displaying.

Since a frame is scanned by 60 Hz in the vertical direction, therefore, the data of a bright frame can be read out directly from a data input terminal without being registered in the memory of the frame buffer. However, the dark frame is separated from the bright frame in displaying time by a difference of half image, therefore, the previous image needs to be registered in the buffer for providing the dark frame with an image output. In order to display a bright line and a dark line during the period of a scan line, the bright and dark frames obtained at a front stage must be stored respectively in the frame line buffer 224 and the frame line buffer 226, followed by individually reading out the bright and dark data from the frame line buffers in a double speed and then by conducting Gamma curve processing and displaying the proceeded data respectively at two positions of the whole frame. In this way, 60 Hz is converted into 120 Hz; but during 16 ms corresponding to a frame period, only one image is needed to be read out from the frame buffer 222. It can be seen that the employed mechanism requires only a half of the conventional bandwidth.

Figure 6:
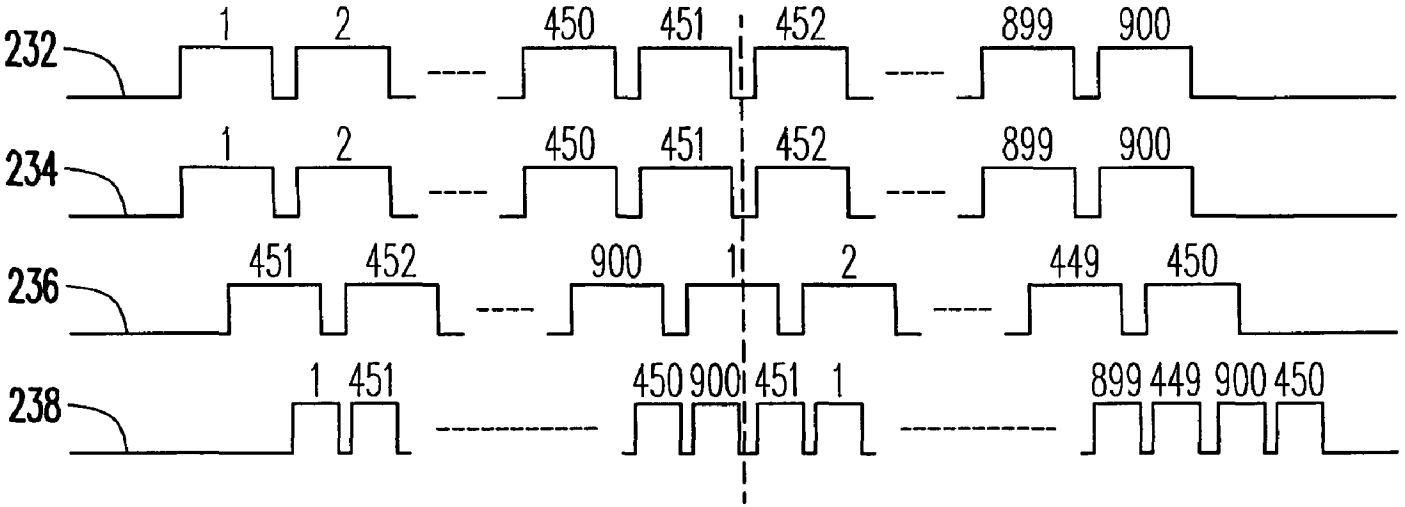
FIG. 6 is the operation timing diagram corresponding to the circuit of FIG. 5.

FIG. 6 is the operation timing diagram corresponding to the circuit of FIG. 5. Referring to FIG. 6, a signal 232 represents an input frame data, which contains, for example, 900 scan lines, and the scan lines from No. 1 to No. 450 are defined as a prior-part frame and the scan lines from No. 451 to No. 900 are defined as a post-part frame. All the 900 scan lines are sequentially input during 16 ms.

Another signal 234 represents a timing sequence for writing the data into the memory, for example, an SDRAM, of the frame buffer 222 and for inputting the data to the frame line buffer 226. Further, another signal 236 represents a timing sequence for reading out the scan line data from the frame doubler. Since the data is first written into the scan line No. 1 which is different from the scan line No. 451 to be read out, therefore, the writing operation does not affect the previously stored frame data. In general, whenever an image is input, the input image would be immediately written into the frame buffer 222 and the frame line buffer 226. When a certain amount of data is stored into the frame line buffer, the stored data starts to be read out from the frame line buffer in a double rate. Yet another signal 238 represents two scan lines respectively belonging to the prior-part block and the post-part block; and after the two scan line data are processed respectively by using a bright Gamma curve and a dark Gamma curve, the two scan line data as a bright data and a dark data to constitute an image are simultaneously displayed. For example, the bright scan line No. 1 of the present image and the dark scan line No. 451 of the previous image are simultaneously displayed. After displaying the bright scan line No. 450 of the present image, as shown by a dotted line in FIG. 6, the second image frame starts to be displayed. The second image frame includes the continuously displayed post-part of the present image frame, which is corresponding to the bright scan line No. 451 and beyond. The prior-part image frame of the present image after conducting dark Gamma processing is displayed at the block originally displaying the scan lines from No. 1 to No. 450. For a pair of scan lines in the signal 238, the post scan line data is read from the signal 236 and then processed.

Figure 7:
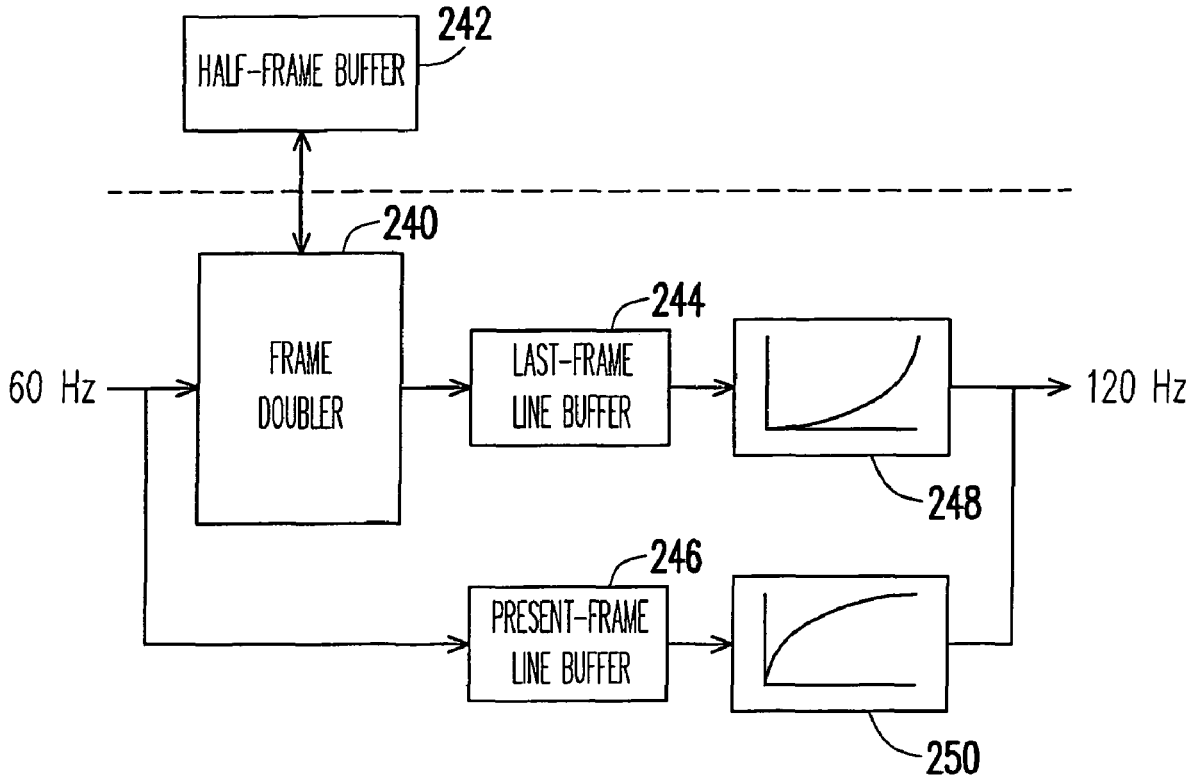
FIG. 7 is a diagram of an image-driving method according to another embodiment of the present invention.

FIG. 7 is a diagram of an image-driving method according to another embodiment of the present invention. Referring to FIG. 7, the image-driving circuit includes a frame doubler 240, a half-frame buffer 242, a previous-frame line buffer 244, a present-frame line buffer 246, a dark Gamma adjustment unit 248 and a bright Gamma adjustment unit 250. The circuit of FIG. 7 and the operation are similar to those in FIG. 5 except that the reading timing in FIG. 7 is modified so that the capacity of the half-frame buffer 242 is merely required to store a part of the data of a whole image, and it is preferred to store the data of a half image.

Figure 8:
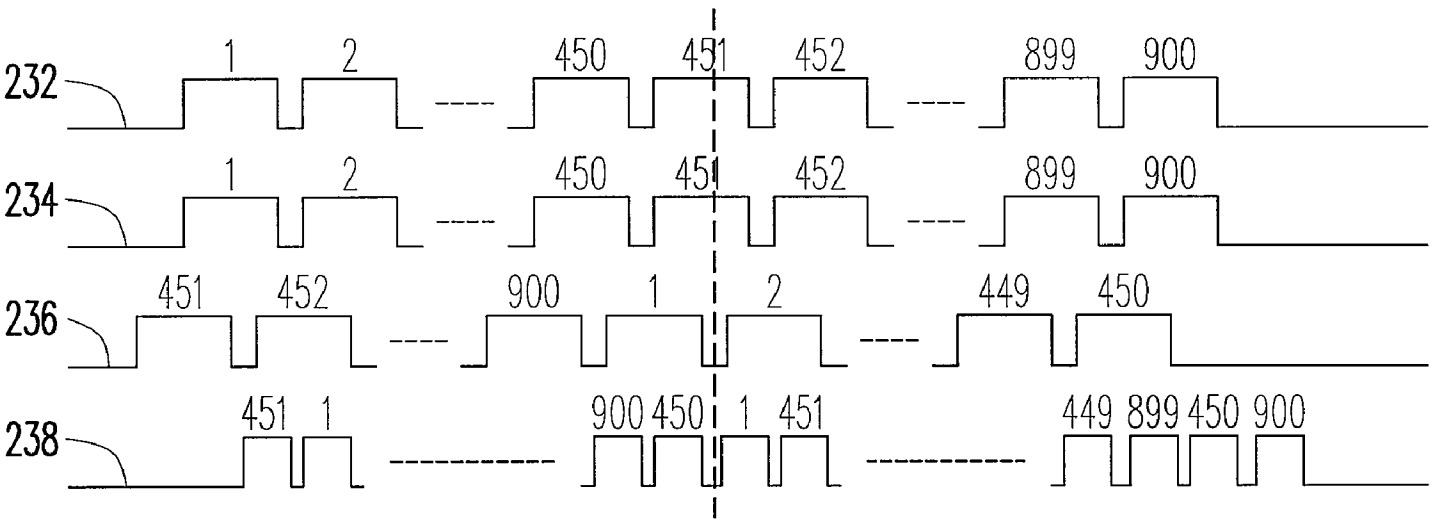
FIG. 8 is the operation timing diagram corresponding to the circuit of FIG. 7.

FIG. 8 is the operation timing diagram corresponding to the circuit of FIG. 7. In FIG. 8, the signal 236 is a timing sequence of the read data. If a capacity of the half-frame buffer 242 is not sufficient for storing the data of a complete image, the write-in data 234 may change the originally stored data, which are not yet performed with bright or dark process. However, the data of the signal 236 has been read out before the write-in signal 234. The data, read from the previous scan line of the pair of scan lines in the signal 238, is processed first, and therefore the data, not being processed yet, are not damaged. The capacity of the half-frame buffer 242 can then be reduced. In this embodiment, the capacity of the half-frame buffer 242 is for storing half-image, as the example. However, it is not the only condition. Further, the bright and dark process is also just the embodiments. The bright frame and the dark frame in frame display can also be exchanged without changing the displaying mechanism. However, the display manner for the current image being first processed with the bright gamma curve can have the better vision effect.

Figure 9:
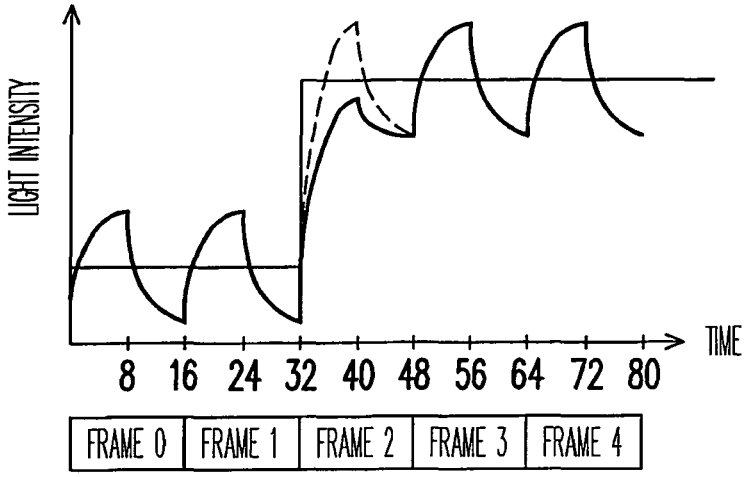
FIG. 9 is a diagram showing the varied light intensity of a pixel in a display apparatus with display time, wherein both the double-Gamma algorithm and the over-drive mechanism are adopted according to an embodiment of the present invention.

As mentioned before, the above-described mechanism allows combining an overdrive architecture. FIG. 9 is a diagram showing the varied light intensity of a pixel in a display apparatus with display time, wherein both the double-Gamma algorithm and the overdrive mechanism are adopted according to an embodiment of the present invention. Referring to FIG. 9, for the frame rate with 60 Hz, an image frame can be displayed in 16 ms. It is the varying curve between the light intensity and the timing for a single image pixel, when the image data has the luminance change. The step-like solid line in FIG. 9 represents the real output data signal with a present luminance fluctuation. After conducting a double-gamma algorithm on the original data, the actual output data appears bright and dark in alternative change. However, when the two original images of the present one and the previous one have large change in luminance, it then needs to consider the issue about slow response time of the liquid crystal. As shown by bold solid line in FIG. 9, since the present image (for example, the frame 2) and the previous image (for example, the frame 1) have relatively large luminance difference, the bright frame of the image frame 2 is unable to immediately responding to reach a supposed luminance, and the luminance between frame 2 and frame 3 has difference. The overall luminance difference occurs between the frame 2 and the frame 3, accordingly causing blur for the motion image. In this regard, overdrive mechanism is an effective solution to overcome the above-mentioned problem. In particular, an algorithm combining the overdrive mechanism and the double-Gamma correction mechanism is an effective solution. In order to save the memory and avoid excessive accesses to/from the memory, the present invention conducts the overdrive processing on bright frames only. After conducting appropriate luminance compensation, the improvement is obtained as shown by the dotted line in FIG. 9.

Figure 10:
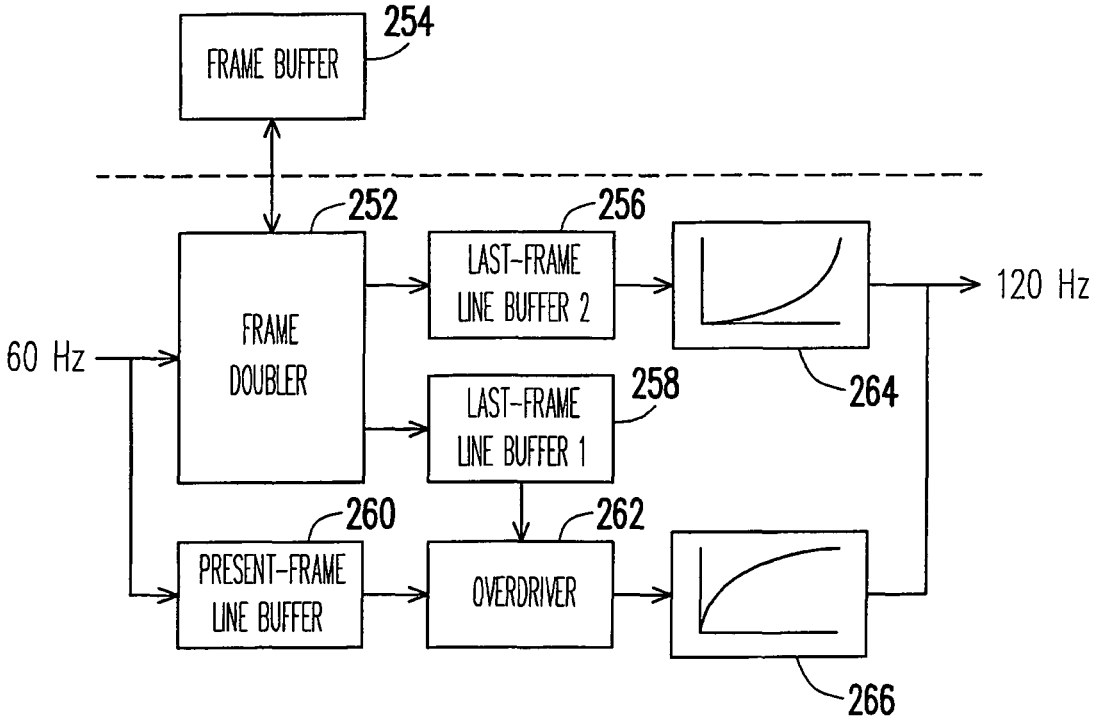
FIG. 10 is a diagram of an image-driving method according to yet another embodiment of the present invention.

FIG. 10 is a diagram of an image-driving method according to yet another embodiment of the present invention. Referring to FIG. 10, an image-driving circuit for a display includes a frame buffer 254, a frame doubler 252, a first frame line buffer 260, a second frame line buffer 256, a third frame line buffer 258, an overdriver 262, a first luminance adjustment unit 266 and a second luminance adjustment unit 264, wherein the frame doubler 252 is coupled to the frame buffer 254 and receives an image frame in a first frequency and then writes the received image frame into the frame buffer 254 according to the sequence of the scan lines.

The first frame line buffer 260 sequentially and directly receives the scan lines of the above-mentioned image frame. The image frame is also divided into a prior-part image frame serving as a part of the image data of first output frame and a post-part image frame serving as a part of the image data of a second output frame. The second frame line buffer 256 reads out a part of the image frame stored in the frame buffer 254 through the frame doubler 252. This part of the image frame, corresponding to the prior-part image frame of the first output frame, reads the post-part image frame of the previously-received image frame. Alternatively, this part of the image frame, corresponding to the post-part image frame of the second output frame, reads the prior-part image frame of the image frame. The third frame line buffer 258 reads out a part of data stored in the frame buffer 254 of the above-mentioned image frame through frame doubler 252 and the read out data is corresponding to a part of the image frame read by the first frame line buffer 260. The overdriver 262 receives the partial data output from the first frame line buffer 260 and the partial data output from the third frame line buffer 258. The overdriver 262 adjusts the partial image data output from the first frame line buffer 260 according to an overdrive mechanism. The first luminance adjustment unit 266 is coupled to the overdriver 262 and adjusts the input image frame with the first luminance condition. The second luminance adjustment unit 264 is coupled to the second frame line buffer 256 and adjusts the input image frame with the second luminance condition. Wherein, the prior-part image frame and the post-part image frame, after conducting luminance adjustments thereon respectively, constitute the above-mentioned first frame and second frame for outputting in a second frequency.

The circuit of FIG. 10 is similar to the circuit of FIG. 5, but the overdrive mechanism of FIG. 9 is added. In other words, when the luminance difference between the present image and the previous image is over a preset value, the overdrive processing is conducted. Since the overdrive processing needs the previous image data to meet the need, the third frame line buffer 258 would register the previous image data first. The registered image data are serving as one of the input data required by the overdrive. The above mentioned is an embodiment to start the overdrive mechanism. In general speaking, the time of starting the overdrive mechanism is depending on a requirement in practice. For example, when the received image frame is different from the previous image frame and if it is needed, the overdrive processing would be started.

In the actual operation, to conduct an overdrive processing on a bright frame, the data of the previous frame needs to be registered for comparison purpose, so that when a data is input in a frame rate of 60 Hz, the overdrive result after the comparison can be immediately obtained and the result is serving as a bright frame for outputting. Meanwhile, the half-image data required by the dark frame can be extracted from the registered previous frame. Then, two different Gamma curves are used to adjust the above-mentioned two frames to output an image, which is termed as the double-Gamma algorithm. Since the prior half-image data required by a dark frame has been contained in the complete previous frame required by the overdrive processing, thus, no need to increase the capacity of the memory; however, considering the data required by both the bright frame and the dark frame must be read out from the memory at a same time, therefore, the required bandwidth is double of that in the above-described embodiment.

Figure 11:
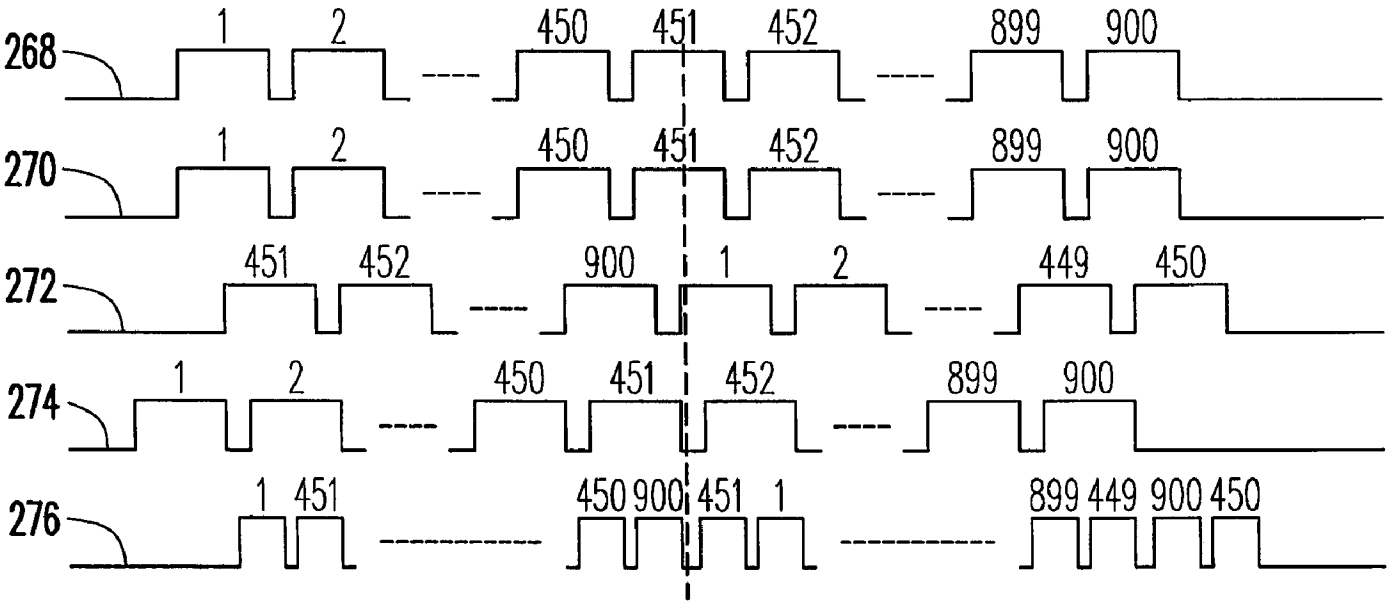
FIG. 11 is the operation timing diagram corresponding to the circuit of FIG. 10, where both the double-Gamma algorithm and the over-drive mechanism are adopted.

FIG. 11 is the operation timing diagram corresponding to the circuit of FIG. 10, where both the double-Gamma algorithm and the over-drive mechanism are adopted. Referring to FIG. 11, after a data signal 268 is input in a frame rate of 60 Hz, the input signal would be immediately written into the memory and the present frame line buffer, which is shown by the signal 270. The data required to conduct an overdrive processing, for example, a signal 274, must be read out in advance so as to avoid the data from being overwritten by the newly written signal 270. In terms of the signal 272, the data of the post-part frame is read out first, which is the same as the above-mentioned mechanism. Finally, the signal 276 after the processing is output in a double rate for the successive displaying.

In other words, once the present frame line buffer and the previous frame line buffer respectively contain a certain amount of data stored therein, an overdrive operation on the bright frame is started in the double rate. Meanwhile, it starts to read out the dark frame data from the frame buffer 254 and then the read-out data are stored in the second frame line buffer 256. After the operation on the bright frame and the result thereof is output for displaying, the dark frame data stored in the second frame line buffer 256 would be immediately read out in the double rate so as to complete the displaying of the dark frame.

The image-driving method provided by the present invention, basically, includes receiving an image frame and registering at least a portion of the image frame. The image frame is divided into a prior-part frame and a post-part frame. Then, a first luminance adjustment is conducted on the prior-part frame and the post-part frame, and the adjusted results are respectively serving as a first part of the first image frame and a first part of the second image frame. After that, the data of the previously received image frame after a second luminance processing is filled in a second part of the first image frame. The data of presently received image frame after the second luminance processing is filled in a second part of the second image frame. Further, the complete first image frame and the complete second image frame are output for the successive displaying.

Figure 12:
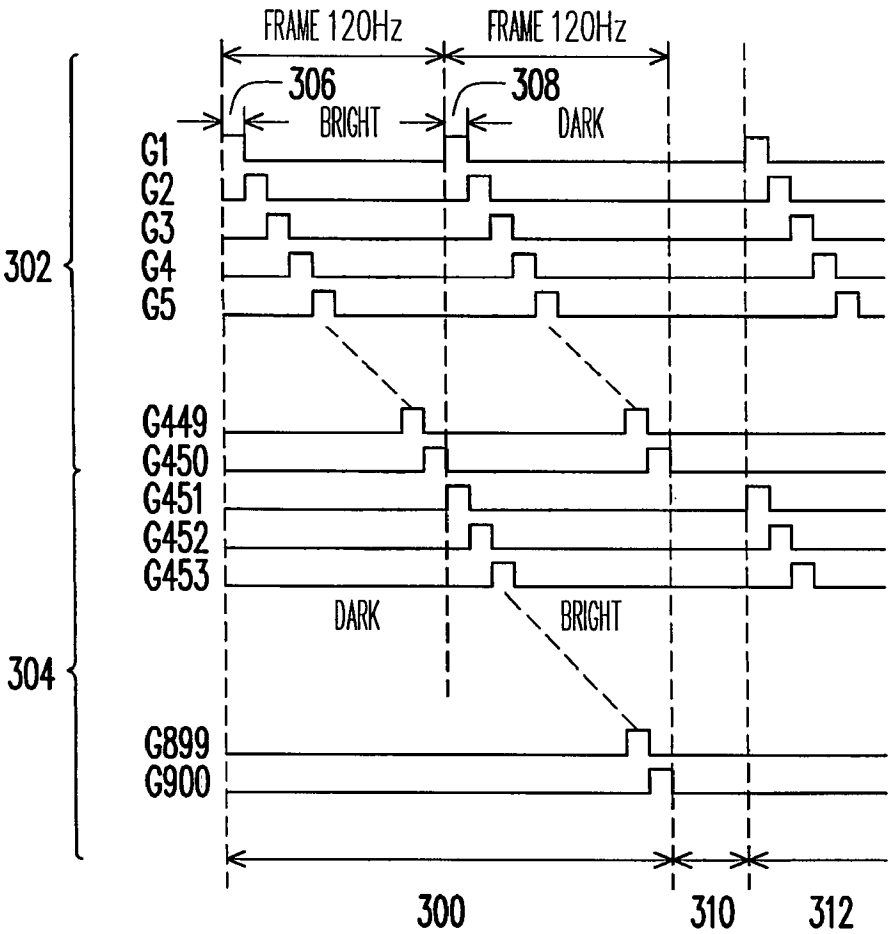
FIG. 12 is the operation timing diagram for scan line frames according to an embodiment of the present invention.

The present invention is applicable to a display apparatus. FIG. 12 is the operation timing diagram for scan line frames according to an embodiment of the present invention. Referring to FIG. 12, the display apparatus includes a plurality of horizontal scan lines and the number of the scan lines depends on the resolution of the display apparatus. In the embodiment, 900 scan lines, G1-G900, are used. Each scan line constitutes a line frame. The whole frame is composed of 900 scan lines to display an image in 120 Hz. Note that, similarly to the mechanism of FIG. 4, a complete image is the frame 300 in 60 Hz of frame rate and the complete frame is composed of two sub-frames respectively displayed in 120 Hz.

According to the present invention, a frame includes, for example, an upper half-frame 302 and a lower half-frame 304, wherein based on a rule the scan lines G1-G450 are serving as the upper half-frame and the scan lines G451-G900 are serving as the lower half-frame. A scan line signal 306 and another scan line signal 308 in FIG. 12 respectively allow the pixel data belonging to the scan lines displayed. The present invention conducts a color luminance correction on the image data of the upper half-frame and another color luminance correction on the image data of the lower half-frame. In a frame period, the upper half-frame 302 and the lower half-frame 304 are simultaneously displayed, and they are sequentially displayed with the displaying time to produce a series of images. Note that the two color luminance corrections for the next frame 312 are alternately switched. For example, two adjacent frames belonging to the upper frame 302 and two adjacent frames belonging to the lower half-frame 304 are displayed in manner of bright-dark-bright-dark . . . . The section 310 in FIG. 12 represents a safety blank region, and the disclosed scheme provided by the present invention can cover the section 310 as well, and the case including the section 310 and the above-mentioned scheme is applied to would not limit to 900 scan lines. In other words, the upper half-frame includes scan lines not limit to G1-G450 and the lower half-frame includes scan lines not limit to G451-G900.

Figure 13:
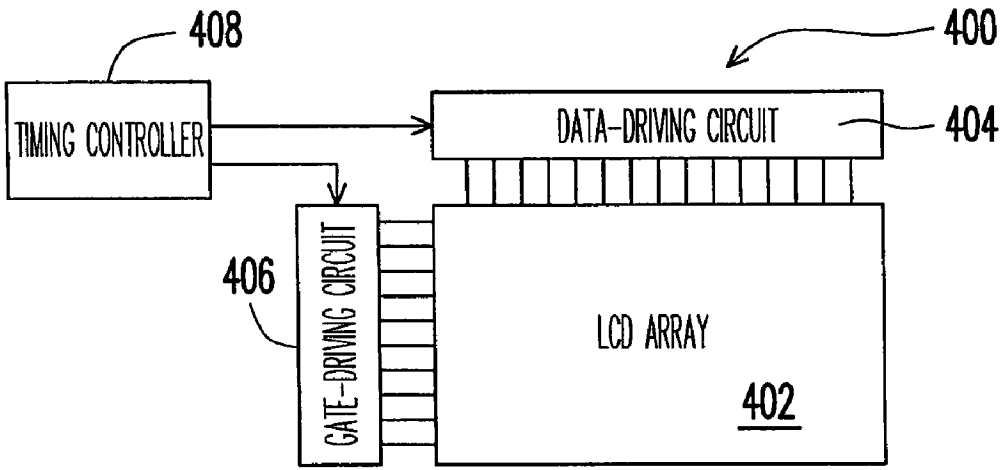
FIG. 13 is a diagram of a display apparatus according to an embodiment of the present invention.

For a display apparatus, the driving mechanism of the present invention is implemented by the driving circuit of the display apparatus. FIG. 13 is a diagram of a display apparatus according to an embodiment of the present invention. Referring to FIG. 13, a display apparatus 400 includes a display array 402 composed of a plurality of pixels, wherein the display array has a plurality of rows serving as a plurality of scan lines and the scan lines are divided into a first set of scan lines and a second set of scan lines. A driving circuit in the display apparatus includes a data-driving circuit 404 for providing the pixels with gray level data, a gate-driving circuit 406 for providing a scan signal to drive the scan lines and a timing controller 408 for controlling the timings of the data-driving circuit 404 and the gate-driving circuit 406. The mechanism of the present invention can be implemented in the driving circuit so as to achieve the desired controls, wherein the first set of scan lines and the second set of scan lines are sequentially displayed in a same frame period, and the two color luminance corrections on the first set of scan lines and the second set of scan lines are alternately switched.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An image-driving method used in a driving circuit to drive a display, comprising:

registering a post-part image frame of a previous image frame by the driving circuit;

receiving an image frame divided into a prior-part image frame and a post-part image frame by the driving circuit; and producing a first display frame and a second display frame to be sequentially displayed corresponding to the image frame by the driving circuit, wherein the first display frame and the second display frame are respectively divided into a prior-part frame and a post-part frame to be simultaneously displayed following a rule used by the driving circuit, wherein the rule comprises:

displaying an image data of the prior-part image frame of the received image frame at the prior-part frame of the first display frame, wherein the prior-part image frame is adjusted with a first luminance condition;

displaying an image data of the post-part image frame of the previous image frame at the post-part frame of the first display frame, wherein the post-part image frame is adjusted with a second luminance condition;

displaying an image data of the prior-part image frame of the received image frame at the prior-part frame of the second display frame, wherein the prior-part image frame is adjusted with the second luminance condition; and displaying an image data of the post-part image frame of the received image frame at the post-part frame of the second display frame, wherein the post-part image frame is adjusted with the first luminance condition.

2. The image-driving method according to claim 1, wherein the received image frame is received in a frequency, the produced first display frame and second display frame are produced in a multiple times of the frequency and the first display frame and the second display frame are sequentially displayed.

3. The image-driving method according to claim 1, wherein the first luminance condition and the second luminance condition are different from a desired luminance condition.

4. The image-driving method according to claim 1, wherein the post-part image frame belonging to the first output frame does not display image.

5. The image-driving method according to claim 1, wherein when the received image frame is different from the previous image frame, the method further comprises conducting an overdriving processing on the data of the image frame.

6. An image-driving circuit for a display, comprising:

a frame buffer;

a frame doubler, coupled to the frame buffer for receiving an image frame in a first frequency and writing the image frame into the frame buffer according to a sequence of scan lines;

a first frame line buffer, sequentially and directly receiving a scan line of the image frame, wherein the image frame is divided into a prior-part image frame as a part of image data of a first output frame and a post-part image frame as a part of image data of a second output frame;

a first luminance adjustment unit, coupled to the first frame line buffer and adjusting the input image frame with a first luminance condition;

a second frame line buffer, using the frame doubler to read out a part of image frame stored in the frame buffer, wherein the prior-part image frame corresponding to the first output frame reads out the post-part image frame of the previous received image frame, or the post-part image frame corresponding to the second output frame reads out the prior-part image frame of the image frame; and a second luminance adjustment unit, coupled to the second frame line buffer and adjusting the input image frame with a second luminance condition, wherein the prior-part image frame and the post-part image frame after the luminance adjustments compose the first frame and the second frame for being output in a second frequency.

7. The image-driving circuit for a display according to claim 6, wherein the second frequency for outputting is a multiple of the first frequency for inputting.

8. The image-driving circuit for a display according to claim 6, wherein the first luminance condition is different from a desired luminance condition.

9. The image-driving circuit for a display according to claim 6, wherein the post-part image frame belonging to the first output frame does not display image.

10. The image-driving circuit for a display according to claim 6, wherein the capacity of the frame buffer is sufficient to store the data of a frame.

11. The image-driving circuit for a display according to claim 6, wherein the capacity of the frame buffer is sufficient to store the data of a half frame.

12. The image-driving circuit for a display according to claim 6, wherein the second frame line buffer starts reading data prior to inputting the present image frame.

13. The image-driving circuit for a display according to claim 6, wherein the second frame line buffer starts reading data after inputting the present image frame.

14. An image-driving circuit for a display, comprising:

a frame buffer;

a frame doubler, coupled to the frame buffer for receiving an image frame in a first frequency and writing the image frame into the frame buffer according to a sequence of scan lines;

a first frame line buffer, sequentially and directly receiving a scan line of the image frame, wherein the image frame is divided into a prior-part image frame as a part of image data of a first output frame and a post-part image frame as a part of image data of a second output frame;

a second frame line buffer, using the frame doubler to read out a part of image frame stored in the frame buffer, wherein the prior-part image frame corresponding to the first output frame reads out the post-part image frame of the previous received image frame, or the post-part image frame corresponding to the second output frame reads out the prior-part image frame of the image frame;

a third frame line buffer, using the frame doubler to read out a part of data belonging to the previous image frame and stored in the frame buffer, wherein the read out data is corresponding to the part of image data of the first output frame or the part of image data of the second output frame received from the first frame line buffer;

an overdriver, receiving the part of image data of the first output frame or the part of image data of the second output frame receiving from the first frame line buffer and the part of data output from the third frame line buffer, and adjusting the luminance of the part of image data of the first output frame or the part of image data of the second output frame receiving from the first frame line buffer according to an overdrive mechanism;

a first luminance adjustment unit, coupled to the overdriver and adjusting the input image frame with a first luminance condition; and a second luminance adjustment unit, coupled to the second frame line buffer and adjusting the input image frame with a second luminance condition, wherein the prior-part image frame and the post-part image frame after the luminance adjustments constitute the first frame and the second frame for being output in a second frequency.

15. The image-driving circuit for a display according to claim 14, wherein the second frequency for outputting is a multiple of the first frequency for inputting.

16. The image-driving circuit for a display according to claim 14, wherein the first luminance condition is different from a desired luminance condition.

17. The image-driving circuit for a display according to claim 14, wherein the post-part image frame belonging to the first output frame does not display image.

18. The image-driving circuit for a display according to claim 14, wherein the capacity of the frame buffer is sufficient to store the data of a frame.

19. The image-driving circuit for a display according to claim 14, wherein the capacity of the frame buffer is sufficient to store the data of a half frame.

20. The image-driving circuit for a display according to claim 14, wherein the second frame line buffer starts receiving data prior to inputting the present image frame.

21. The image-driving circuit for a display according to claim 14, wherein the second frame line buffer starts receiving data after inputting the present image frame.

22. The image-driving circuit for a display according to claim 14, wherein the overdrive mechanism is that when the received image frame is different from the previous image frame and, depending on need, an overdrive processing is conducted on the image frame.

23. An image-driving method used in a driving circuit to drive a display, comprising:

receiving by the driving circuit an image frame and registering at least a part of the received image frame, wherein the image frame has a prior-part frame and a post-part frame;

respectively conducting a first luminance adjustment on the prior-part frame and the post-part frame by the driving circuit so as to take the adjusted parts as a first part of a first image frame and a first part of a second image frame;

filling the data of the previous received image frame after a second luminance processing into a second part of the first image frame by the driving circuit;

filling the data of the received image frame after a second luminance processing into a second part of the second image frame by the driving circuit; and outputting the complete first image frame and the complete second image frame for successive displaying by the driving circuit.

24. An image-driving method used in a driving circuit to drive a display apparatus, comprising:

dividing a plurality of scan lines of a display frame into a first set of scan lines and a second set of scan lines according to a sequence of the scan lines by the driving circuit;

receiving an input image data by the driving circuit;

alternately conducting an image color correction by the driving circuit according to a frame sequence on a first part of the input image data with one of a first color luminance correction and a second color luminance correction, wherein the first part is corresponding to the first set of scan lines and needs to be displayed, and the results of the image color corrections are provided to the first set of scan lines for displaying;

alternately conducting an image color correction by the driving circuit according to a frame sequence on a second part of the input image data with the other one of the second color luminance correction and a first color luminance correction, wherein the second part is corresponding to the second set of scan lines; and in a same frame period, sequentially displaying an output display image of the first set of scan lines and the second set of scan lines.

25. The image-driving method according to claim 24, wherein the first set of scan lines and the second set of scan lines individually display a half of the output display image or a preset proportion of the output display image.

26. The image-driving method according to claim 24, wherein the frame rate of the display frame is 120 Hz.

* * * * *